United States Patent [19]

Brodeur et al.

[11] Patent Number: 4,771,703

[45] Date of Patent: Sep. 20, 1988

[54] RAILROAD FLATCAR WITH AXLE GUARDS

[76] Inventors: Rene H. Brodeur, 2108 Beechwood Ave., Wilmette, Ill. 60091; Boris S. Terlecky, 6422 MacArthur Dr., Woodridge, Ill. 60517; Ronald P. Sellberg, 5 South 649 Wright St., Naperville, Ill. 60540

[21] Appl. No.: 144,615

[22] Filed: Jan. 11, 1988

Related U.S. Application Data

[63] Continuation of Ser. No. 733,905, May 14, 1985, abandoned.

[51] Int. Cl.[4] ..... B61F 3/00; B61F 5/42

[52] U.S. Cl. ..... 105/157.1; 105/199.5; 105/222; 105/171

[58] Field of Search ..... 105/157.1, 171, 199.5, 105/206.1, 206.2, 218.1, 222, 223, 224.05, 224.06

[56] References Cited

U.S. PATENT DOCUMENTS

| | | | |
|---|---|---|---|
| 2,180,392 | 11/1939 | Blunt | 105/222 |
| 2,685,847 | 8/1954 | Waldvogel | 105/199 S X |
| 2,953,994 | 9/1960 | Furrer et al. | 105/199 S X |
| 3,286,653 | 11/1966 | Weber | 105/171 X |
| 4,433,629 | 2/1984 | Roush | 105/222 |
| 4,561,360 | 12/1985 | Mulcahy | 105/199 S |
| 4,589,346 | 5/1986 | Miller | 105/171 |

FOREIGN PATENT DOCUMENTS

| | | | |
|---|---|---|---|
| 898153 | 11/1953 | Fed. Rep. of Germany | 105/218 R |
| 1254170 | 11/1967 | Fed. Rep. of Germany | 105/199 S |
| 191552 | 1/1923 | United Kingdom | 105/224 A |
| 900097 | 7/1962 | United Kingdom | 105/199 S |
| 1232695 | 5/1971 | United Kingdom | 105/199 S |

*Primary Examiner*—James B. Marbert

*Attorney, Agent, or Firm*—Kinzer, Plyer, Dorn, McEachran & Jambor

[57] ABSTRACT

A railroad flatcar including an elongated center sill having undercarriage frames secured thereto at opposite ends thereof is disclosed. A single axle wheel truck is fixed to each undercarriage frame and suspends the car. Axle guard plate is provided to limit movement of the car laterally of the wheel trucks and to provide a restoring force to the car.

9 Claims, 5 Drawing Sheets

RAILROAD FLATCAR WITH AXLE GUARDS

This is a continuation of co-pending application Ser. No. 733,905 filed May 14, 1985, now abandoned.

BACKGROUND OF THE INVENTION

This invention relates to railroad cars, and more particularly, to an improved railroad flatcar construction employing single axle trucks.

Conventional railroad flatcars include a structural frame supported for movement over a pair of rails by a wheel truck at each end of the car. The car frame is suspended on the wheel trucks through springs, and is provided with means necessary to support and connect lading thereto. The railroad car to which the present invention relates is the type which is constructed to support and transport truck trailers.

Railroad flatcars of this type must be structurally strong. At the same time, it is desirable that such railroad cars be light weight and include the necessary torsional flexibility so that the wheels (of the wheel trucks) remain in proper contact with the rails. Also, it is desirable that single axle wheel trucks, rather than double axle wheel trucks, be employed which adds more importance to the torsional flexibility required to maintain the wheels in proper contact with the rails.

There is more than one commercially available single axle wheel truck construction available so that it is advantageous that the flatcar frame be adaptable for use with as many different wheel truck constructions as possible. Also, it is important that the flatcar frame remain stable on the wheel trucks and not be permitted to sway or the wheel trucks to oscillate relative to the car.

The present invention achieves the aforementioned goals by providing a railroad flatcar construction adapted for transporting truck trailers and the like, which is structurally sound and of a minimum weight, and is adapted for use with a variety of single axle wheel trucks. The flatcar includes a structural frame constructed to provide torsional flexibility about its length to help maintain the wheels in proper engagement with the rails, and which is constructed to limit and cushion movement of the car frame laterally of the wheel trucks and to dampen oscillation of the wheel trucks longitudinally relative to the car.

SUMMARY OF THE INVENTION

The present invention encompasses a railroad car which comprises a center sill forming a car frame and extending substantially the entire length of the car, and a wheel truck at each end of the car. The wheel trucks each include a single axle extending transversely of the center sill with a wheel at each end of each of the axles. Springs at each side of each of the wheel trucks suspend the frame, and the center sill includes relatively rigid end portions and an intermediate portion which is torsionally flexible about an axis extending longitudinally of the center sill, whereby to help maintain the wheels in engagement with their respective rails.

In another aspect, the invention encompasses a railroad car comprising a structural frame supported at opposite ends by first and second single axle wheel trucks each having a pair of rail engaging wheels at opposite ends of an axle. A bearing housing adaptor means is provided at each end of each of the axles and includes bearings rotatably supporting the wheels and the axles. Axle guard means on each side of the frame and at both ends thereof is in spaced confronting relation to respective ones of the bearing housing adaptor means limiting permitted lateral movement of the frame relative to the wheel trucks.

In yet another aspect, the present invention encompasses a railroad car comprising a structural frame supported at opposite ends by first and second single axle wheel trucks each having a pair of rail engaging wheels at opposite ends of an axle. Spring means suspends the frame on each of the wheel trucks, and damper means is provided interconnecting the wheel trucks and the frame and is operable of the car to dampen oscillation of the wheel trucks relative to the car.

In still another aspect, the present invention encompasses a railroad car comprising a structural frame supported at opposite ends by first and second single axle wheel trucks, the frame including an elongated center sill extending substantially the entire length of the car. A pair of spaced transverse support beams at each end of the car extend transversely of the center sill and are welded thereto underneath the center sill. Connectors are fixed to each end of each of the support beams, and the wheel trucks each include a single axle having a pair of wheels at each end, bearing housings enclosing bearings rotatably supporting the wheels and the axles, suspension spring means connected to the bearing housings, and swing hangers connecting the connectors to the suspension springs.

In yet another aspect, the invention encompasses a railroad car comprising an elongated center sill supported at opposite ends by wheel trucks, the center sill being a box beam construction extending substantially the entire length of the car. Means is provided for supporting the wheels of a truck trailer at one end of the car including a plurality of longitudinally spaced pairs of cross rails extending transversely of the car, the cross rails each including a beam welded to each side of the center sill and extending outwardly therefrom, and a stringer welded to the inside of the center sill and spanning each pair of beams.

DETAILED DESCRIPTION OF THE DRAWINGS

Figure 1A:
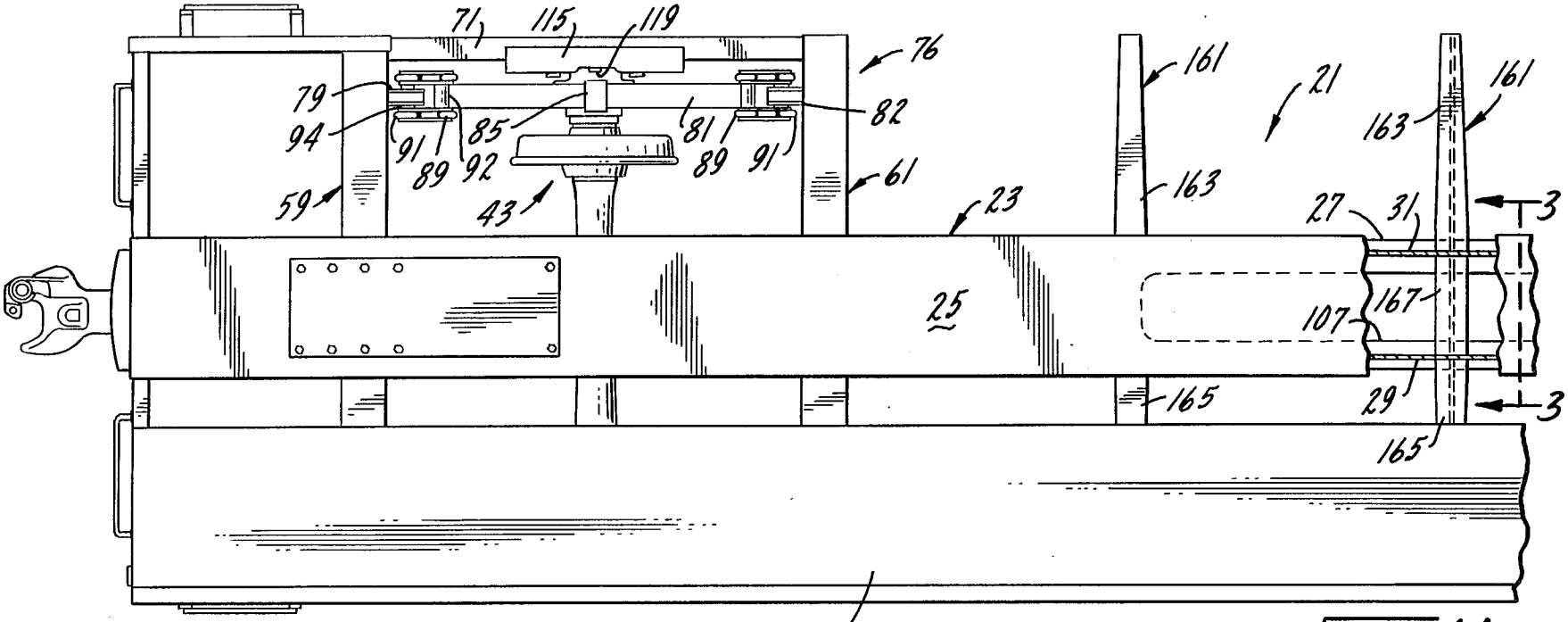
FIGS. 1A and 1B are top plan views, partly in section, showing opposite ends of a railroad flatcar constructed according to the present invention and supported upon single axle wheel trucks at each end thereof.
Figure 2A:
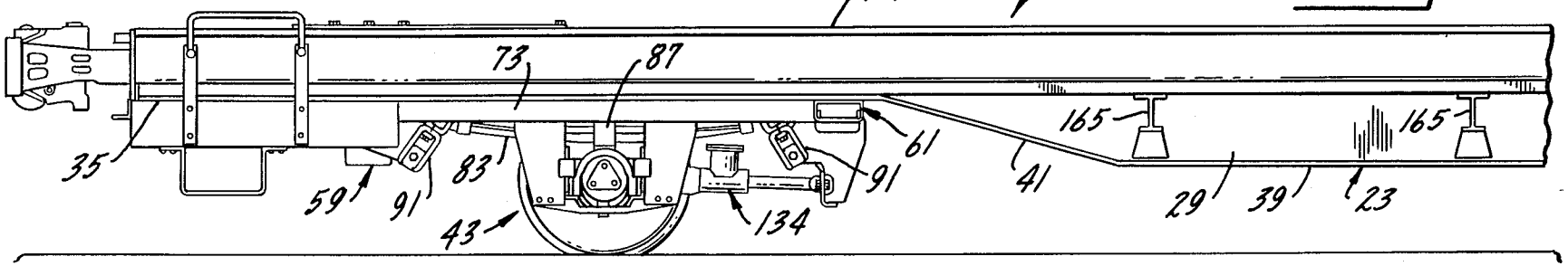
FIGS. 2A and 2B are side views of the structure of FIGS. 1A and 1B, respectively.
Figure 1B:
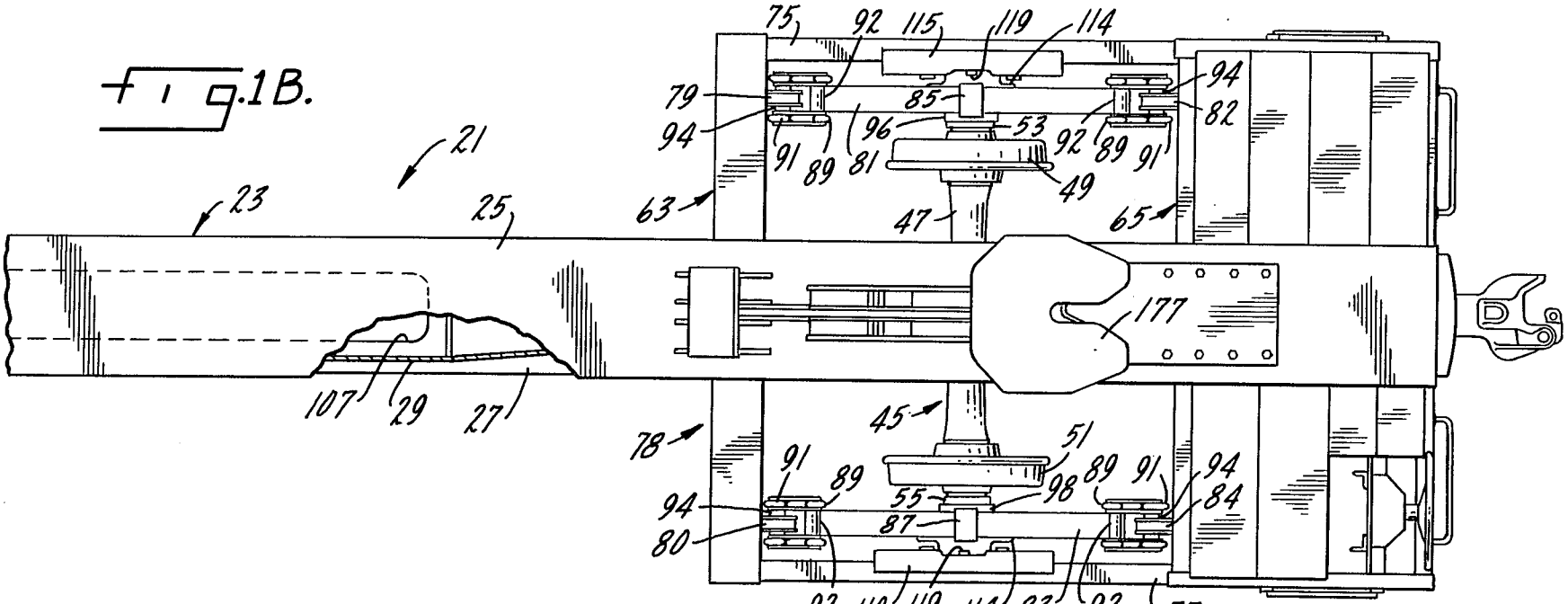
Figure 2B:
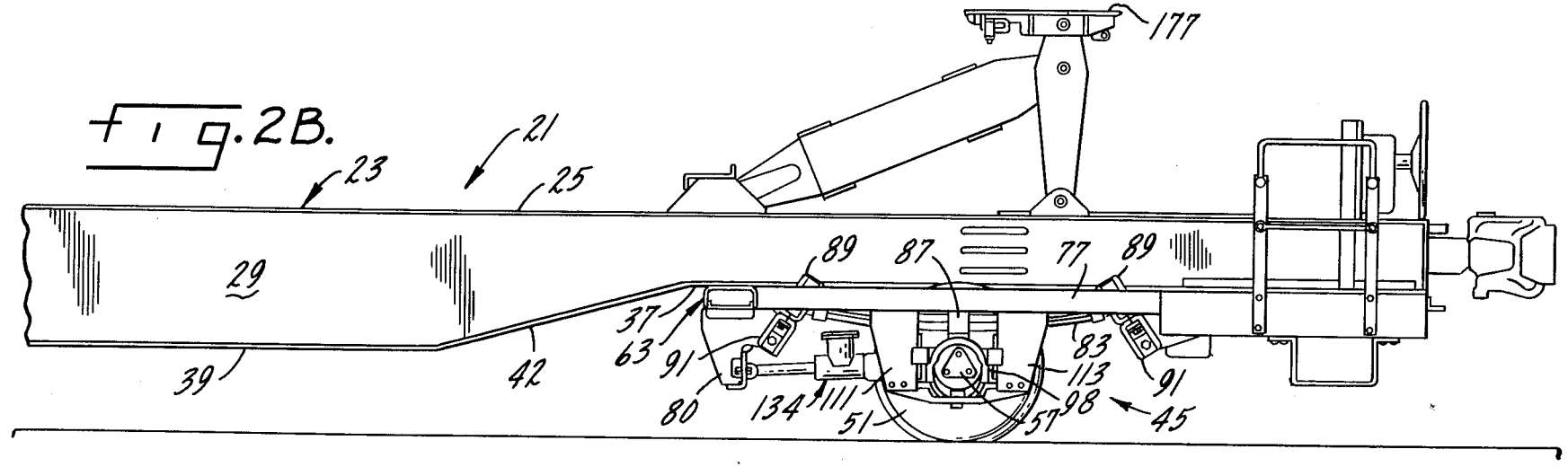

Referring now to the drawings, a railroad car embodying the present invention is illustrated generally at 21 in FIGS. 1 and 2 and is seen to include a structural frame comprising a center sill extending substantially the entire length of the car. As embodied herein, the center sill is shown at 23 and is an elongated box beam which is generally rectangular in cross section having a steel top plate 25, bottom plate 27, and side plates 29, 31 which are welded together. (See also FIG. 3). The center sill 23 includes two end sections 35, 37 that are of substantially the same height, and a center section 39 which is of a substantially greater height or thickness. A pair of tapered transition sections 41, 42 connect the center section 39 to the end sections 35, 37, respectively. See FIGS. 2A and 2B.

In accordance with the invention, a wheel truck is provided at each end of the car. Preferably, each wheel truck includes a single axle extending transversely of the center sill with a wheel at each end of each axle. A pair of bearing housings include bearings rotatably supporting the wheels and the axles.

As embodied herein, wheel trucks 43 and 45 are provided at opposite ends of the car 21. The wheel trucks are substantially identical except that some features are reversed, as described hereafter, so that a description of one will suffice here. Similar parts are illustrated by the same numerals.

As shown perhaps best in FIGS. 1B and 2B, wheel truck 45 includes a single axle 47 which extends transversely of the center sill 23 and has rail engaging wheels 49, 51 at opposite ends thereof. Bearing housings 53, 55 are provided at opposite ends of the axle 47 and each encloses a roller bearing device 57 which rotatably supports the wheels and the axle.

Figure 11:
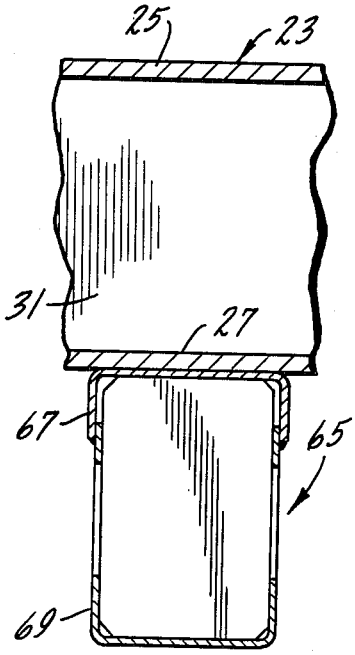
FIG. 11 is an enlarged sectional view of FIG. 7 taken along the line 11—11 thereof.

In accordance with the invention, the car 21 is constructed for attachment to wheel trucks 43, 45 and includes a pair of spaced transverse support beams at each end of the car extending transversely of the center sill and welded thereto underneath the center sill to bottom plate 27 (as shown in FIG. 11). As embodied herein, a pair of spaced transverse beams 59, 61 are provided at one end of the car, 21 adjacent wheel truck 43, shown in FIGS. 1A and 2A, and a second pair of spaced transverse beams 63, 65 are provided at the opposite end of the car (see FIGS. 1B and 2B). Each of the transverse beams 59, 61, 63, 65 is a box beam made up of upper and lower channels 67, 69 welded together as shown for beam 63 in FIG. 5. The upper channel 67 is substantially uniform in dimension and the lower channel 69 increases in height or thickness toward the center of the car. Beams 59, 61, 63 and 65 have a minimum height dimension at their ends, as shown in full lines in FIG. 5 for beam 63, and a maximum height dimension at their mid-section, as shown in FIG. 11.

As further embodied herein, the outer or lateral ends of the transverse beams 59, 61 are joined together by a pair of longitudinal beams 71, 73 which are generally rectangular in cross section and suitably welded thereto. In like fashion, the outer lateral or free ends of transverse beams 63, 65 are joined together by a pair of generally rectangular longitudinal beams 75, 77 which are welded thereto). Beams 59, 61, 71 and 73 form a rigid undercarriage frame, generally indicated at 76 and forming part of the flatcar 21, for attaching the car 21 to wheel frame 43. Beams 63, 65, 75 and 77 form an undercarriage frame 78 which performs the same function for wheel truck 45.

In accordance with the invention, the undercarriage frames are adapted for connection to respective ones of the wheel trucks. As embodied herein, a pair of rigid two-part connectors 79, 80 are welded to transverse beam 63 and a pair of similar two-part connectors 82, 84 are welded to beam 65 in a manner depicted in FIGS. 7 and 8 for undercarriage frame 78. A plurality of swing hangers, each of which is identical having two parts 89, 91 one part 91 being pivoted by a bolt 94 to a respective one of the connectors 79, 80, 82 and 84. The other part 89 of each hanger is connected by a pivot 92 to an adjacent end of a suspension leaf spring described below.

For wheel truck 45, there are two leaf springs 81, 83, one at either side of the wheel truck. The leaf spring 81 is connected at opposite ends to connectors 79, 82 and spring 83 is pivotally connected at opposite ends to connectors 80, 84, in each case through one of the two-part hangers. The mid-section of springs 81, 83 are fixed by bushings 85, 87 to bearing adaptors 82, 84 which are interconnected to bearing housings 53, 55, respectively.

The springs 81, 83 resiliently support the car 21 on the wheel truck 45. The swing hangers can pivot in four (4) directions and permit some lateral sway of the car and some movement of the car longitudinally of the truck 45. Substantially the same construction is provided to connect the wheel truck 43 to the other end of the car 21 so that the car is resiliently suspended at each end on the wheel trucks.

It will be appreciated that the car 21 is connected to each of the wheel trucks 43, 45 through a four-corner connection provided on the undercarriage frames formed by the beams 59, 61, 71, and 73 and 83, 65, 75 and 77. In this embodiment, the undercarriage frames are provided with the connectors 79, 80, 82 and 84 for connection to the swing hangers associated with the suspension springs. In another version of single axle wheel trucks, coil springs are incorporated into a two-part truck housing. In that case, the undercarriage frames can be bolted or otherwise secured to the truck housing requiring, at most, a minor variation in the construction of the connectors (78, 80, 82 and 84).

In accordance with the invention, the center sill is constructed to include relatively rigid end portions, and an intermediate portion which is torsionally flexible about an axis extending longitudinally of the center sill, whereby to help maintain the wheels in engagement with their respective rails. As embodied herein, the box beam arrangement of the center sill described above, including the top plate 25, the bottom plate 27, and side plates 29, 31, extends substantially the entire length of the center sill, including the relatively thick portion 39, the relatively shallow portions 35, 37, and the transition portions 39, 41. This construction inherently is very strong and resistant to both bending and twisting.

An elongated aperture or hole 107 is formed in the bottom plate 27 of the center section 39 so that the center section 39 is less resistant to twisting and is torsionally flexible. This construction, i.e., the relatively stiff end portions 35, 37 and the torsionally flexible center portion 39 functions in a unique manner providing stability and strength for the car 21 and the center sill end portions 35, 37 to which the undercarriages 76, 78 and the wheel trucks 43, 45 are secured, while allowing the end portions to undergo some relative orientation relative to each other through twisting of the center section 39 when the truck wheels encounter irregularities and/or uneven spots in the rails. This adds greatly to the ability of the truck wheels to stay with and maintain proper engagement with the rails.

In accordance with the invention, means is provided on each side of the car at each end thereof to limit lateral movement of the car relative to the wheel trucks and to provide a restoring force to the car relative to the wheel trucks.

Figure 7:
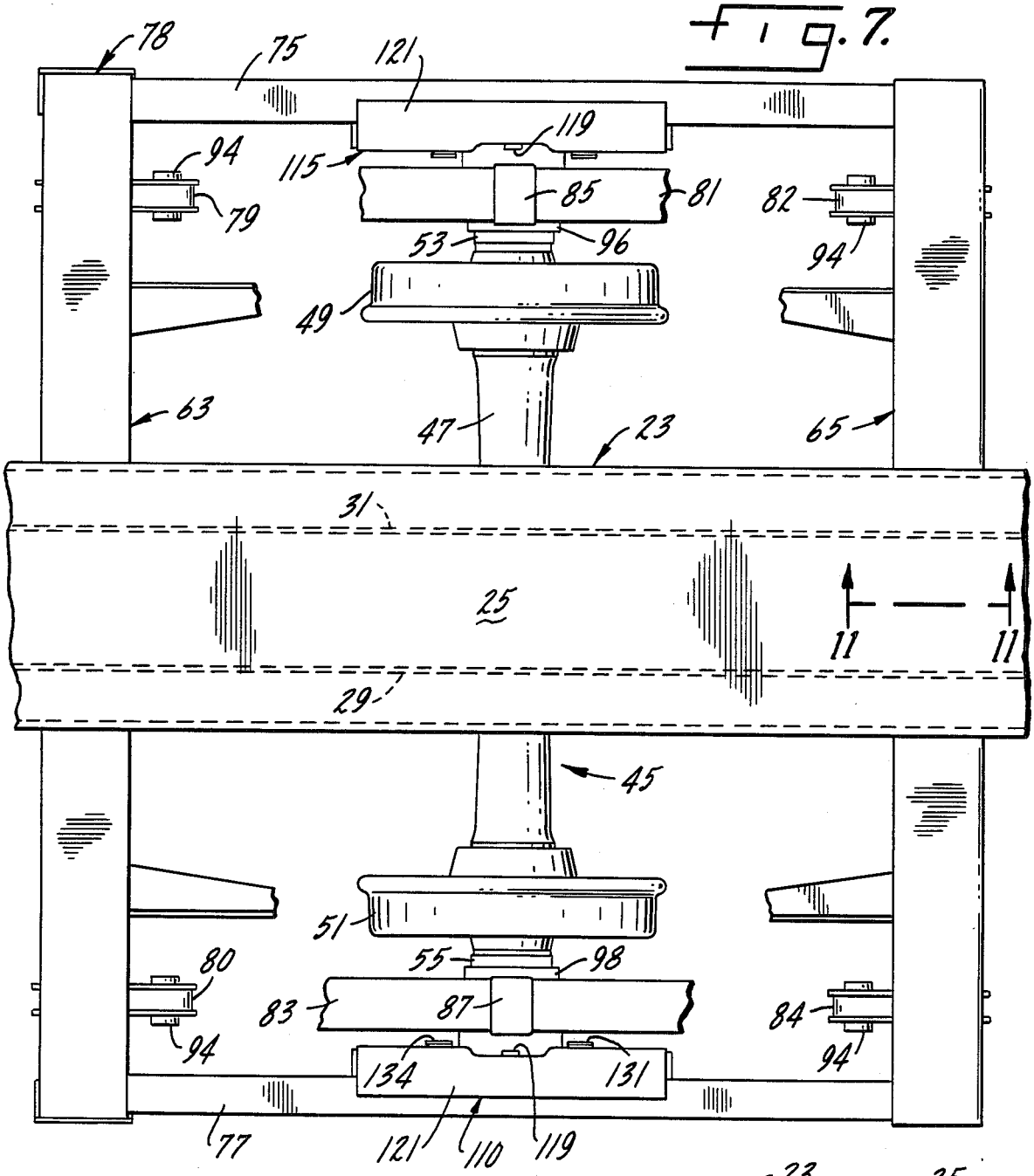
FIG. 7 is an enlarged view of FIG. 1B with parts removed for clarity.
Figure 8:
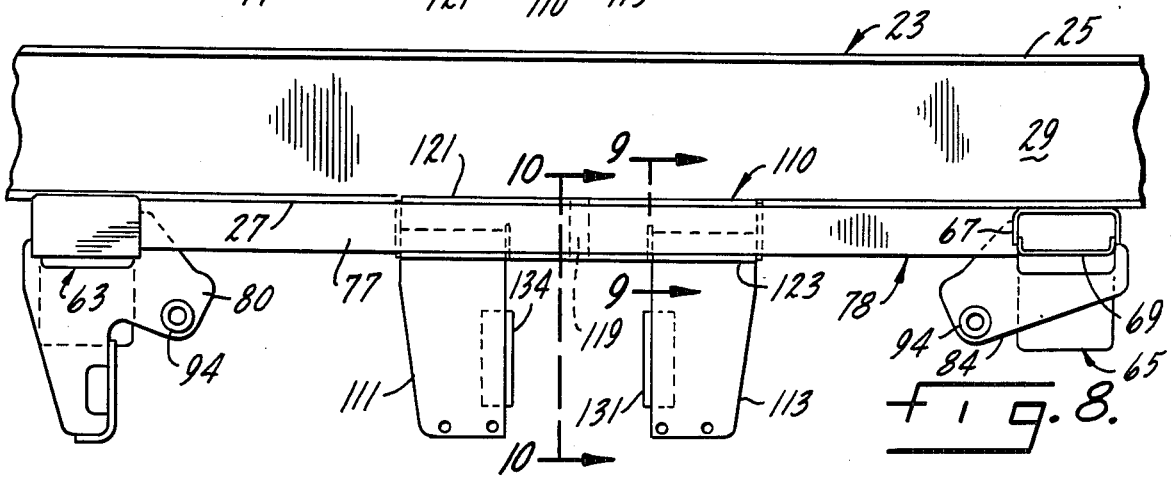
FIG. 8 is a side view of FIG. 7.

As embodied herein and shown in FIGS. 7 and 8, an axle guard 110 is fixed to the inside of longitudinal beam 77 of undercarriage frame 78 and has a pair of plates 111, 113 cantilevered downwardly therefrom. The plates 111, 113 are in spaced confronting relation to outer faces 114 of a bearing adapter 98 forming part of a bearing assembly for wheel 51. In similar fashion, another axle guard 115 is fixed to beam 75 and has plates 117 cantilevered downwardly in spaced confronting relation to an outer face of bearing adaptor 96. Similar axle guards are provided on the beams 71, 73 of undercarriage frame 76 and cooperate with the bearing adaptors of wheel truck 43 so that lateral movement or sway of the car 21 relative to the wheel trucks 43, 45 is limited by engagement of these parts.

During use of the railroad car, forces are imposed on the car 21 causing it to sway or move laterally relative to the wheel trucks 43, 45. A limited amount of movement is permitted, and the clearance between the axle guards and the bearing housings permits this. However, once sufficient movement has occurred to cause one or the other of the bearing adaptors 96, 98 to contact the respective confronting axle guard plates, further lateral movement of the car is resisted and a restoring force is imposed on the car tending to push the car back into alignment with the wheels. The axle guard plates are cantilevered and are flexible at their lower ends so that they provide a restoring force tending to reposition and recenter the car 21 over the wheel trucks 43, 45 upon further lateral car movement. The greater the lateral movement of the car 21, the stronger the counterbalancing force tending to overcome such movement. As an ultimate stop to lateral car movement, an over solid limit stop 119 is provided on the inside surface of each axle guard 110, 115 to engage the bushings 85, 87.

Figure 9:
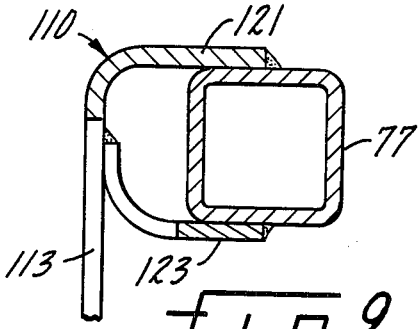
FIG. 9 is an enlarged sectional view of FIG. 8 taken along the line 9—9 thereof.
Figure 10:
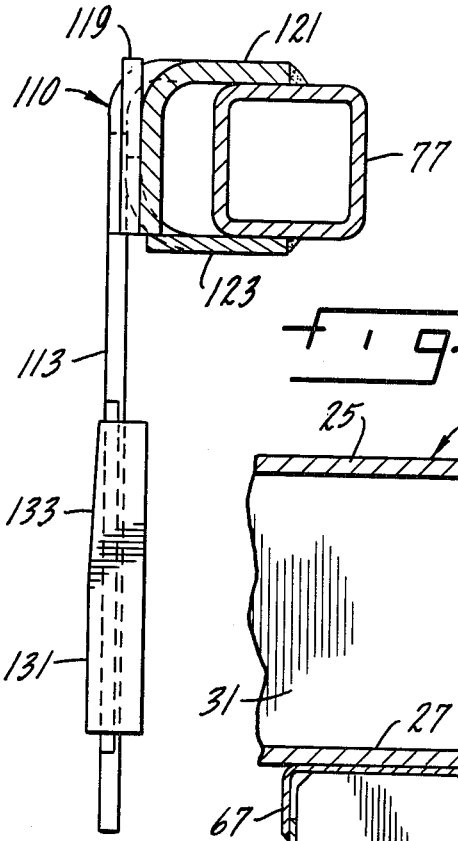
FIG. 10 is an enlarged sectional view of FIG. 8 taken along the line 10—10 thereof.

As further embodied herein, the axle guards 110, 115 are constructed so that stress concentration thereon is minimized during lateral movement or swaying of the car. As shown in FIGS. 9 and 10, guard 110 is formed with a relatively large radius horizontal flange 121 at its top which is welded to the top of longitudinal beam 77. Guard plate 113 is also supported by a large radius angle plate 123 which is welded to the axle guard 113 and to the bottom of the longitudinal beam 77. Thus, when the guard plate 113 is deflected by engagement with the bearing adaptor 98 upon lateral sway of the railroad car which for the plate 113 is in a right-hand direction, as viewed in FIGS. 9 and 10, guard plate 113 undergoes what may be termed a rolling contact with angle plate 123. This prevents excessive and concentrated stress in the guard plate 113 from occurring. Guard plate 111 is constructed and supported in the same manner as guard plate 113, and axle guards 115 are constructed in the same manner as axle guard 110.

Figure 6:
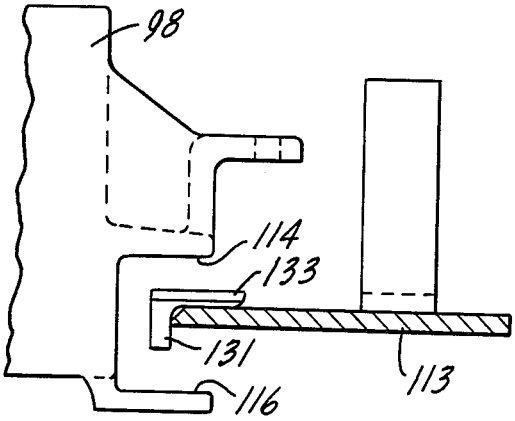
FIG. 6 is a sectional view of FIG. 5 taken along the line 6—6 thereof.

As still further embodied herein, wear plates are provided on each of the axle guards. As shown in FIGS. 6 and 10, a wear plate 131 is welded to guard plate 113. Wear plate 131 has a taper 133 at its upper portion as shown in FIG. 10. As the car moves laterally, the surface 114 of bearing adaptor 98 engages the wear plate 131 and, by virtue of the taper 133, contact between the bearing adaptor 98 and the wear plate 131 moves upwardly on the wear plate as flexure increases. This has the effect of shortening the fulcrum point about which the guard plate 113 bends and and increases the restoring force applied to the bearing adaptor 98 and to the car 21. Guard plate 111 has a similar wear plate 134 welded thereto which is the mirror image of rear plate 131, and the other bearing guards are constructed in the same manner. It will be appreciated that by providing the spaced guard plates, one on either side of the wheel bearings, easy access is allowed to the wheel bearings in the event such is needed.

Bearing adaptors 98 each include two flanges 116 best shown in FIG. 6. Flanges 116 define planar vertical surfaces spaced from surfaces 114. The vertical axle guards are captured between surfaces 114 and flanges 116 to retain theaxle guards for limite,d lateral movement and prevent the bearing adaptors 98 from excess lateral movement relative to the axle guard.

It will be appreciated that there is no force that will keep a single axle truck travelling straight down the rail so that it can pivot or swing about an imaginary center vertical axis. Any bump or irregularity encountered will kick the wheel truck one way or the other which is undesirable.

Figures 4, 5:
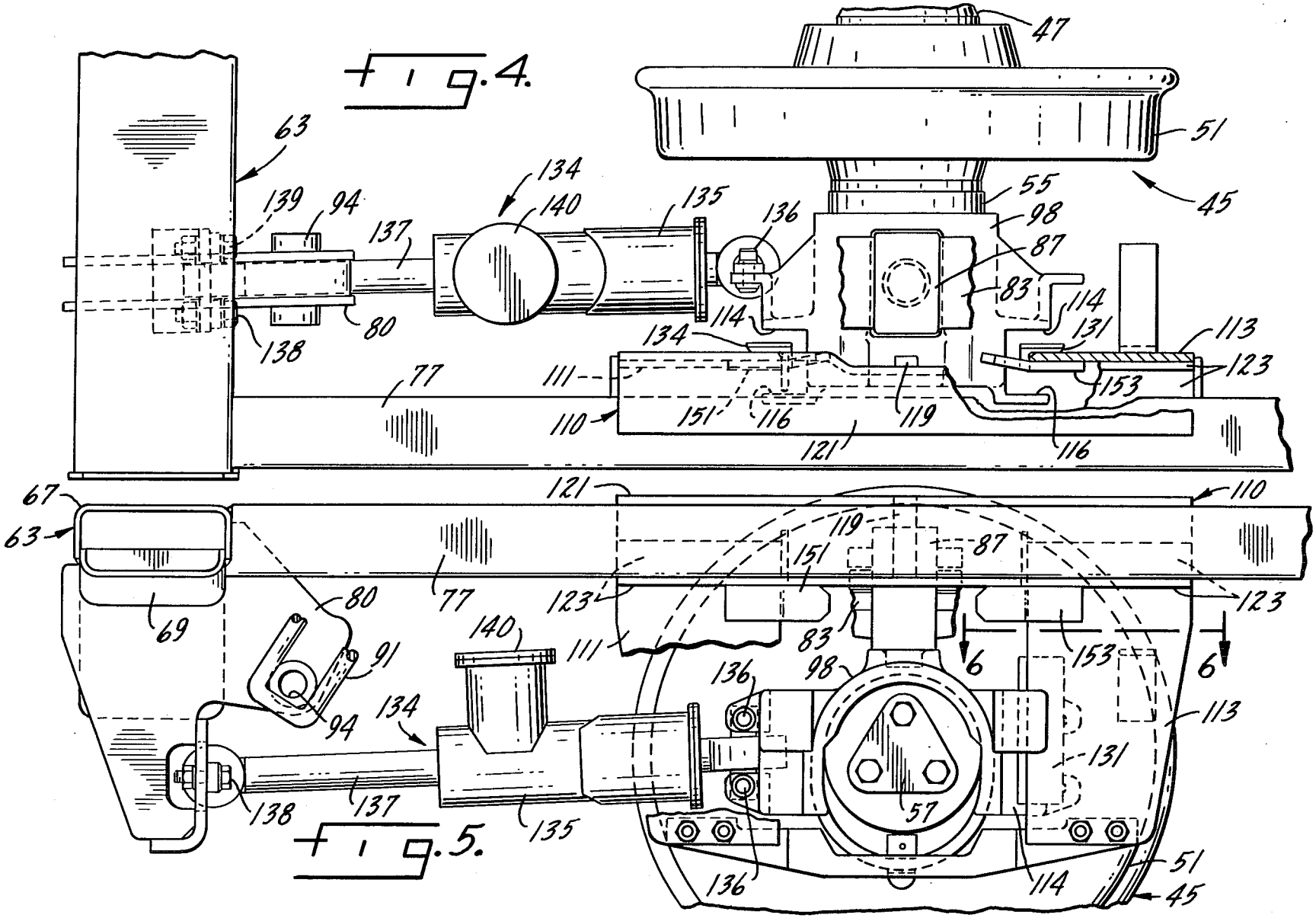
FIG. 4 is an enlarged view of a portion of FIG. 1B with parts removed for clarity.
FIG. 5 is a side view of FIG. 4.

In accordance with the invention, damper means is provided which interconnects the wheel trucks and the car and is operable to dampen oscillation of the wheel trucks relative to the car. As embodied herein and shown in FIGS. 2, 4 and 5, a damper 134 is provided on each side of the center sill 23 and at the inboard ends of each of the wheel trucks 43, 45. In FIG. 4, one of the dampers 134 is illustrated and is seen to include a telescopic piston/cylinder arrangement in which a cylinder 133 is pivoted by a bolt 135 to bearing adaptor 98. A piston 137 is connected by bolts 138, 139 to connector 80. Movement of the piston 137 relative to the cylinder 133 is resisted by fluid pressure in the cylinder and is effective to dampen oscillation of the wheel truck 45 about its imaginary center vertical axis. The same construction is provided for wheel truck 43. An access cap 140 on the dampers facilitates fluid replacement. A representative commercial damper is Koni No. OAR-1121, a product of Koni B.V., 3260 AA Oud-Beijerland, Holland.

In accordance with the invention, means is provided to limit downward vertical movement of the car relative to the wheel trucks. As embodied herein, and shown in FIG. 5, a pair of stops 151, 153 are welded to the bottom of longitudinal beam 77. Stops 151, 153 are positioned to engage the top of bearing adaptor 98 upon a predetermined amount of vertical travel of the car 1 downwardly relative to the wheel truck 45. Similar stops are provided on each of the other longitudinal beams 71, 73 and 75.

As described above, the car of this invention is light weight in construction and includes the center sill 23 and the undercarriage frames 76, 78 at each end for connection to the wheel trucks. When using the car to transport, for example, truck trailers, it is necessary that the kingpin at one end of the trailer be hitched to the car and that the wheels at the other end of the trailer be supported on the car. To this end, a fifth wheel plate 177 of conventional construction is mounted on the center sill 23 near one end thereof. A wheel platform 171 on each side of the center sill 23 (only one shown in FIG. 1A) can be supported for a portion of their length on the undercarriage frame at the other end of car 21, but those platforms are much longer than the undercarriage frame.

In accordance with the invention, means is provided for supporting wheel platforms for trailer wheels at one end of the car, including a plurality of spaced cross rails extending transversely of the car, the cross rails each including a beam welded to each side of the center sill and extending outwardly therefrom, and a stringer welded to the inside of the center sill and spanning the beams.

Figure 3:
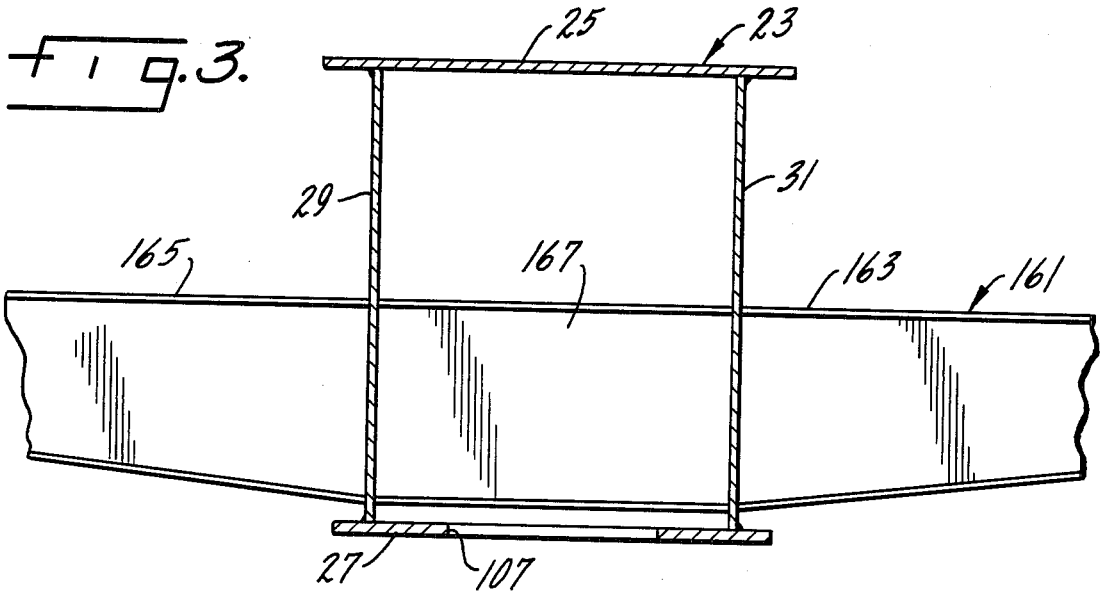
FIG. 3 is an enlarged sectional view of FIG. 1A, taken along the line 3—3 thereof.

As embodied herein, a plurality of spaced cross members 161 are shown extending transversely of the car 21 and of the center sill 23. As shown in FIG. 3, each of the cross members includes aligned beams 163, 165 welded to opposite sides of the center sill 23, and specifically to the side plates 31, 29, respectively. A stringer or strut 167 is welded to the inside of the side plates 29, 31 in alignment with each pair of the beams 163, 165 and spanning the space between them to prevent inward buckling of the center sill side walls.

In use, a wheel platform such as shown at 171 in FIG. 1A is provided on each side of the center sill 23 for supporting the wheels of a trailer on the car 21. The platforms 171 are supported both by the undercarriage frame 76 and the members 161. The kingpin at the other end of the trailer is attached to the fifth wheel plate 177 in the normal manner.

By the foregoing, there has been disclosed a railroad car construction which satisfies the inventive concepts set forth hereinabove. It will be understood that various additions, substitutions, modifications and omissions may be made to the present invention without departing from the scope of spirit or the invention as encompassed by the appended claims. Therefore, it is understood that the present invention encompasses those additions, substitutions, modifications and omissions provided they come within the scope of the appended claims and their equivalents.

What is claimed is:

1. A railroad car comprising a structural frame supported at opposite ends by first and second single axle wheel trucks each having a pair of rail engaging wheels at opposite ends of an axle, bearing housing adaptor means at each end of each of said axles and including bearings rotatably supporting said wheels and said axles, axle guard means associated with each said bearing housing adaptor means depending from said frame outboard of said bearing housing adaptors in spaced confronting relation to respective ones of said bearing housing adaptor means for limiting permitted lateral movement of said frame relative to said wheel trucks, said axle guard means defining resilient plate means engageable with said bearing housing adaptor means and deflectable thereby to develop a restoring force tending to push the car back into alignment with the wheels, said bearing housing adaptor means defining first vertical planar surfaces for engaging said axle guard means to deflect the same to develop said restoring force tending to push the car back into alignment with the wheels and further including flange means defining planar surfaces spaced from such first planar surfaces wherein said axle guard means are disposed intermediate said spaced surfaces, said planar surfaces on said flange means engageable with said axle guard means to deflect the same in an opposite direction to develop forces acting in a direction opposite said restoring forces.

2. The car claimed in claim 1, said frame including a pair of undercarriage frames at opposite ends of said car, and wherein said axle guard plate means are cantilevered from each of said undercarriage frames at opposite sides of said car with the free ends of said plate means in spaced confronting relation to said bearing housing adaptor means intermediate said planar surface on said bearing housing adaptor means and said flange means.

3. The car claimed in claim 2, said plate means being cantilevered downwardly from said undercarriage frames.

4. The car claimed in claim 2, said plate means including means causing the fulcrum point about which said plate means deflects to shorten as deflection increases to increase the restoring force on said car.

5. The car claimed in claim 2, said structural frame including a center sill extending substantially the entire length of said car, said undercarriage frame fixed to said center sill and each including a rectangular frame including pair of longitudinal beams, said plate means connected to a respective one of said longitudinal beams.

6. The car claimed in claim 2, including means providing a rolling contact for said plate means during deflection thereof.

7. The car claimed in claim 6, said plate means including vertical plates cantilevered downwardly from said undercarriage frames, said plate means including a top horizontal flange fixed to said undercarriage frame.

8. The car claimed in claim 2, said plate means including a pair of spaced cantilevered plates in spaced confronting relation to each said bearing housing means.

9. The car claimed in claim 8, including a wear plate fixed to each said cantilevered plate, each said wear plate having a tapered surface confronting said bearing housing means for engagement therewith, each said wear plate further having a planar wear surface confronting said planar surfaces of said flange means for engagement therewith.

* * * * *

UNITED STATES PATENT AND TRADEMARK OFFICE

CERTIFICATE OF CORRECTION

PATENT NO. : 4,771,703

DATED : Sept. 20, 1988

INVENTOR(S) : Rene H. Brodeur et al

It is certified that error appears in the above-identified patent and that said Letters Patent is hereby corrected as shown below:

On the title page Assignee should read:

--(73) Assignee: Trailer Train Company,
Chicago, Illinois --.

Signed and Sealed this

Eleventh Day of April, 1989

*Attest:*

*Attesting Officer*

DONALD J. QUIGG

*Commissioner of Patents and Trademarks*